US008493003B2

(12) United States Patent
Zhao

(10) Patent No.: US 8,493,003 B2
(45) **Date of Patent: *Jul. 23, 2013**

(54) SERIAL CASCADE OF MINIMIUM TAIL VOLTAGES OF SUBSETS OF LED STRINGS FOR DYNAMIC POWER CONTROL IN LED DISPLAYS

(75) Inventor: Bin Zhao, Irvine, CA (US)

(73) Assignee: Freescale Semiconductor, Inc., Austin, TX (US)

( * ) Notice: Subject to any disclaimer, the term of this patent is extended or adjusted under 35 U.S.C. 154(b) by 766 days.

This patent is subject to a terminal disclaimer.

(21) Appl. No.: 12/690,972

(22) Filed: Jan. 21, 2010

(65) Prior Publication Data

US 2010/0201279 A1 Aug. 12, 2010

Related U.S. Application Data

(63) Continuation-in-part of application No. 12/367,672, filed on Feb. 9, 2009, now Pat. No. 8,179,051.

(51) Int. Cl.
*H05B 37/02* (2006.01)

(52) U.S. Cl.
USPC ..... 315/308; 315/312; 315/360

(58) Field of Classification Search
USPC ..... 315/185 R, 209 R, 224–226, 246, 315/247, 291, 294, 307, 308, 312, 324, 360
See application file for complete search history.

(56) References Cited

U.S. PATENT DOCUMENTS

| | | | |
|---|---|---|---|
| 3,973,197 | A | 8/1976 | Meyer |
| 4,162,444 | A | 7/1979 | Rodgers |
| 4,615,029 | A | 9/1986 | Hu et al. |
| 4,649,432 | A | 3/1987 | Watanabe et al. |

(Continued)

FOREIGN PATENT DOCUMENTS

| | | | |
|---|---|---|---|
| JP | 2003332624 | A | 11/2003 |
| JP | 2005116199 | A | 4/2005 |
| KR | 1020070082004 | A | 8/2007 |
| WO | 2005022596 | A2 | 3/2005 |

OTHER PUBLICATIONS

Notice of Allowance mailed Jan. 9, 2012 for U.S. Appl. No. 12/367,672, filed Feb. 9, 2009, entitled "Serial Configuration for Dynamic Power Control in LED Displays", 14 pages.

(Continued)

*Primary Examiner* — Jimmy Vu

(57) ABSTRACT

A light emitting diode (LED) system implements a power management technique. The LED system includes a plurality of LED drivers connected in series, each LED driver configured to regulate the current flowing through a corresponding subset of a plurality of LED strings. Each LED driver determines the tail voltages of the one or more LED strings of the corresponding subset. Each LED driver, except for the first LED driver in the series, also receives a voltage representative of the minimum tail voltage of the other subsets regulated by the upstream LED drivers. Each LED driver then provides the lowest of the voltage received from the upstream LED driver and the one or more tail voltages of the corresponding subset to the downstream LED driver. In this manner a voltage representative of the minimum tail voltage of the plurality of LED strings is cascaded through the series. A feedback controller monitors the minimum tail voltage represented by this cascaded voltage and accordingly adjusts an output voltage provided to the head ends of the plurality of LED strings.

20 Claims, 7 Drawing Sheets

U.S. PATENT DOCUMENTS

| | | | | |
|---|---|---|---|---|
| 4,686,640 | A | 8/1987 | Simison | |
| 5,025,176 | A | 6/1991 | Takeno | |
| 5,038,055 | A | 8/1991 | Kinoshita | |
| 5,455,868 | A | 10/1995 | Sergent et al. | |
| 5,508,909 | A | 4/1996 | Maxwell et al. | |
| 5,635,864 | A | 6/1997 | Jones | |
| 5,723,950 | A | 3/1998 | Wei et al. | |
| 6,002,356 | A | 12/1999 | Cooper | |
| 6,281,822 | B1 | 8/2001 | Park | |
| 6,373,423 | B1 | 4/2002 | Knudsen | |
| 6,636,104 | B2 | 10/2003 | Henry | |
| 6,822,403 | B2 | 11/2004 | Horiuchi et al. | |
| 6,864,641 | B2 | 3/2005 | Dygert | |
| 6,943,500 | B2 | 9/2005 | LeChevalier | |
| 7,211,958 | B2 | 5/2007 | Maurer et al. | |
| 7,262,724 | B2 | 8/2007 | Hughes et al. | |
| 7,307,614 | B2 | 12/2007 | Vinn | |
| 7,315,095 | B2 | 1/2008 | Kagemoto et al. | |
| 7,391,280 | B2 | 6/2008 | Hsu | |
| 7,436,378 | B2 | 10/2008 | Ito et al. | |
| 7,459,959 | B2 | 12/2008 | Rader et al. | |
| 7,511,545 | B1 | 3/2009 | Kesler | |
| 7,598,686 | B2 | 10/2009 | Lys et al. | |
| 7,696,915 | B2 | 4/2010 | Chmelar et al. | |
| 7,777,704 | B2 | 8/2010 | S et al. | |
| 7,888,888 | B2 | 2/2011 | Huang et al. | |
| 7,973,495 | B2 | 7/2011 | Ion et al. | |
| 8,179,051 | B2 * | 5/2012 | Zhao | 315/185 R |
| 2002/0003511 | A1 | 1/2002 | Havel | |
| 2004/0208011 | A1 | 10/2004 | Horiuchi et al. | |
| 2004/0233144 | A1 | 11/2004 | Rader et al. | |
| 2006/0164162 | A1 | 7/2006 | Dauphinee et al. | |
| 2006/0186830 | A1 | 8/2006 | Shami et al. | |
| 2006/0261895 | A1 | 11/2006 | Kocaman et al. | |
| 2007/0080911 | A1 | 4/2007 | Liu et al. | |
| 2007/0146191 | A1 | 6/2007 | Iwata et al. | |
| 2007/0253330 | A1 | 11/2007 | Tochio et al. | |
| 2007/0290915 | A1 | 12/2007 | Morimoto | |
| 2008/0054815 | A1 | 3/2008 | Kotikalapoodi | |
| 2008/0129224 | A1 | 6/2008 | Shih et al. | |
| 2008/0143576 | A1 | 6/2008 | Chen et al. | |
| 2008/0238341 | A1 | 10/2008 | Korcharz et al. | |
| 2008/0297067 | A1 | 12/2008 | Wang et al. | |
| 2009/0108775 | A1 | 4/2009 | Sandner et al. | |
| 2009/0128045 | A1 | 5/2009 | Szczeszynski et al. | |
| 2009/0187925 | A1 | 7/2009 | Hu et al. | |
| 2009/0230874 | A1 | 9/2009 | Zhao et al. | |
| 2009/0230891 | A1 | 9/2009 | Zhao et al. | |
| 2009/0273288 | A1 | 11/2009 | Zhao et al. | |
| 2009/0315481 | A1 | 12/2009 | Zhao | |
| 2010/0013395 | A1 | 1/2010 | Archibald et al. | |
| 2010/0013412 | A1 | 1/2010 | Archibald et al. | |
| 2010/0026203 | A1 | 2/2010 | Zhao et al. | |
| 2010/0085295 | A1 | 4/2010 | Zhao et al. | |
| 2010/0156315 | A1 | 6/2010 | Zhao et al. | |

OTHER PUBLICATIONS

Notice of Allowance mailed Dec. 14, 2011 for U.S. Appl. No. 12/363,179, filed Jan. 30, 2009, entitled "LED Driver With Segmented Dynamic Headroom Control", 14 pages.

Non-Final Office Action mailed Mar. 13, 2012 for U.S. Appl. No. 12/504,841, filed Jul. 17, 2009, 38 pages.

Non-Final Office Action mailed Apr. 19, 2011 for U.S. Appl. No. 12/363,294, 19 pages.

Non-Final Office Action mailed Apr. 19, 2011 for U.S. Appl. No. 12/363,607, 17 pages.

Notice of Allowance mailed Jun. 21, 2011 for U.S. Appl. No. 12/340,985, 27 pages.

Non-Final Office Action mailed May 4, 2011 for U.S. Appl. No. 12/367,672, 26 pages.

Notice of Allowance mailed Jul. 2, 2012 for U.S. Appl. No. 12/504,841, 11 pages.

Final Office Action mailed May 1, 2012 for U.S. Appl. No. 12/183,492, 15 pages.

Notice of Allowance mailed Jun. 12, 2012 for U.S. Appl. No. 12/183,492, 6 pages.

Notice of Allowance mailed Sep. 27, 2011 for U.S. Appl. No. 12/504,335, 35 pages.

Notice of Allowance mailed Apr. 7, 2011 for U.S. Appl. No. 12/326,963, 20 pages.

Notice of Allowance mailed Aug. 1, 2011 for U.S. Appl. No. 12/363,294, 11 pages.

*Ex parte Quayle* mailed Jul. 20, 2011 for U.S. Appl. No. 12/363,1790, 25 pages.

Notice of Allowance mailed Aug. 11, 2011 for U.S. Appl. No. 12/363,607, 9 pages.

Final Office Action mailed Oct. 20, 2011 for U.S. Appl. No. 12/367,672, 24 pages.

Non-Final Office Action mailed Jan. 18, 2012 for U.S. Appl. No. 12/183,492, filed Jul. 31, 2008, 37 pages.

Mc Nerney, Tim, "constant-current power supply for Luxeon 5W LED with low-voltage warning and shut-off Software Documentation, as shipped to Mali in first 45 prototypes," Nov. 2004, www.designthatmatters.org/ke/pubs/kled-doc.txt, 5 pages.

Maxim: "Application Note 810, Understanding Flash ADCs," Oct. 2, 2001, 8 pages.

National Semiconductor Data Sheet: "LM3432/LM3432B 6-Channel Current Regulator for LED Backlight Application," May 22, 2008, pp. 1-18.

U.S. Appl. No. 12/537,443, filed Aug. 7, 2009, entitled Pulse Width Modulation Frequency Conversion'.

U.S. Appl. No. 12/703,239, filed Feb. 10, 2010, entitled "Pulse Width Modulation With Effective High Duty Resolution".

U.S. Appl. No. 12/537,692, filed Aug. 7, 2009, entitled "Phase-Shifted Pulse Width Modulation Signal Generation".

U.S. Appl. No. 12/625,818, filed Nov. 25, 2009, entitled "Synchronized Phase-Shifted Pulse Width Modulation Signal Generation".

U.S. Appl. No. 12/703,249, filed Feb. 10, 2010, entitled "Duty Transition Control in Pulse Width Modulation Signaling".

Luke Huiyong Chung, Electronic Products: "Driver ICs for LED BLUs," May 1, 2008, 3 pages.

Akira Takahashi, Electronic Products: "Methods and features of LED drivers," Mar. 2008, 3 pages.

U.S. Appl. No. 12/340,985, filed Dec. 22, 2008, entitled "LED Driver With Feedback Calibration".

U.S. Appl. No. 12/326,963, filed Dec. 3, 2008, entitled "LED Driver With Precharge and Track/Hold".

U.S. Appl. No. 12/367,672, filed Feb. 9, 2009, entitled "Configuration for Dynamic Power Control in LED Displays".

U.S. Appl. No. 12/424,326, filed Apr. 15, 2009, entitled "Peak Detection With Digital Conversion".

U.S. Appl. No. 12/504,841, filed Jul. 17, 2009, entitled "Analog-To-Digital Converter With Non-Uniform Accuracy".

Texas Instruments Publication, "Interleaved Dual PMW Controller with Programmable Max Duty Cycle," SLUS544A, Sep. 2003, pp. 1-28.

U.S. Appl. No. 12/363,607, filed Jan. 30, 2009, entitled "LED Driver With Dynamic Headroom Control".

International Application No. PCT/US2009/035284, Search Report and Written Opinion, Oct. 28, 2009, 11 pages.

Office Action—NFOA Feb. 4, 2010, 11 pages.

Office Action—NOA Jun. 2, 2010, 7 pages.

Office Action—NOA Jul. 9, 2010, 12 pages.

International App. No. PCT/US2009/065913, Search Report mailed Jul. 7, 2010, 4 pages.

Notice of Allowance mailed Jul. 19, 2011 for U.S. Appl. No. 12/424,326, 27 pages.

PCT Application No. PCT/US2010/028289; Search Report and Written Opinion dated Dec. 15, 2010.

* cited by examiner

SERIAL CASCADE OF MINIMIUM TAIL VOLTAGES OF SUBSETS OF LED STRINGS FOR DYNAMIC POWER CONTROL IN LED DISPLAYS

CROSS-REFERENCE TO RELATED APPLICATIONS

The present application claims priority as a continuation-in-part application to U.S. patent application Ser. No. 12/367,672, filed on Feb. 9, 2009, and entitled "Serial Configuration for Dynamic Power Control in LED Displays," the entirety of which is incorporated by reference herein.

FIELD OF THE DISCLOSURE

The present disclosure relates generally to light emitting diodes (LEDs) and more particularly to LED drivers.

BACKGROUND

Light emitting diodes (LEDs) often are used as light sources in liquid crystal displays (LCDs) and other displays. The LEDs often are arranged in parallel "strings" driven by a shared power source, each LED string having a plurality of LEDs connected in series. To provide consistent light output between the LED strings, each LED string typically is driven at a regulated current that is substantially equal among all of the LED strings.

Although driven by currents of equal magnitude, there often is considerable variation in the bias voltages needed to drive each LED string due to variations in the static forward-voltage drops of individual LEDs of the LED strings resulting from process variations in the fabrication and manufacturing of the LEDs. Dynamic variations due to changes in temperature when the LEDs are enabled and disabled also can contribute to the variation in bias voltages needed to drive the LED strings with a fixed current. In view of this variation, conventional LED drivers typically provide a fixed voltage that is sufficiently higher than an expected worst-case bias drop so as to ensure proper operation of each LED string. However, as the power consumed by the LED driver and the LED strings is a product of the output voltage of the power source and the sum of the currents of the individual LED strings, the use of an excessively high output voltage unnecessarily increases power consumption.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

FIGS. 1-14 illustrate example techniques for power management in a light emitting diode (LED) system having a plurality of LED strings. A power source provides an output voltage to the head end of each of the plurality of LED strings to drive the LED strings. The LED system includes a plurality of LED drivers connected in series, each LED driver configured to regulate the current flowing through a corresponding subset of the plurality of LED strings. Each LED driver determines the minimum, or lowest, tail voltage of the one or more LED strings of the corresponding subset, compares this with an indicator of a minimum tail voltage of one or more other subsets provided from an upstream LED driver in the series, and then provides an indicator of the lower voltage of the two tail voltages to the downstream LED driver in the series. In this manner an indicator of the overall minimum tail voltage of the plurality of LED strings is cascaded through the series of LED drivers. A feedback controller monitors the minimum tail voltage represented by the cascaded indicator and adjusts the output voltage of the power source accordingly. In at least one embodiment, the feedback controller adjusts the output voltage so as to maintain the overall minimum tail voltage of the plurality of LED strings at or near a predetermined threshold voltage. This ensures that the output voltage is sufficient to properly drive each active LED string at a regulated current with desired current accuracy and pulse width modulation (PWM) timing requirements without excessive power consumption. Further, as described below, the series of LED drivers can be configured to cascade digital indicators of minimum tail voltages (e.g., as codes generated by analog-to-digital converters at the LED drivers) or to cascade analog indicators of minimum tail voltages (e.g., the minimum tail voltages themselves, or representations thereof).

The term "LED string," as used herein, refers to a grouping of one or more LEDs connected in series. The "head end" of a LED string is the end or portion of the LED string which receives the driving voltage/current and the "tail end" of the LED string is the opposite end or portion of the LED string. The term "tail voltage," as used herein, refers the voltage at the tail end of a LED string or representation thereof (e.g., a voltage-divided representation, an amplified representation, etc.). The term "subset of LED strings" refers to one or more LED strings.

Figure 1:
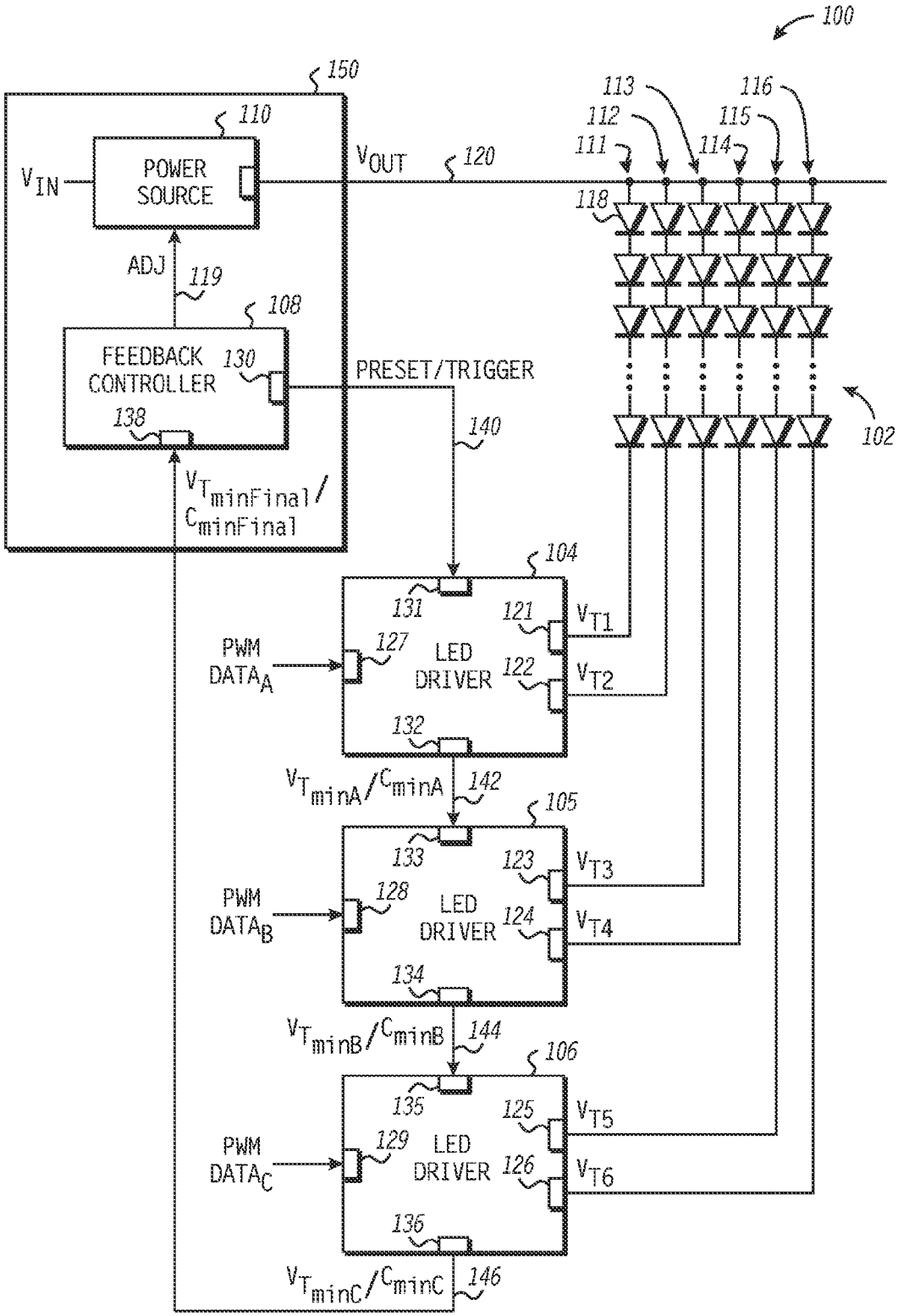
FIG. 1 is a diagram illustrating a light emitting diode (LED) system having dynamic power management in accordance with at least one embodiment of the present disclosure.

FIG. 1 illustrates a LED system 100 having dynamic power management in accordance with at least one embodiment of the present disclosure. In the depicted example, the LED system 100 includes a LED panel 102, a plurality of LED drivers connected in series (e.g., LED drivers 104, 105, and 106), a feedback controller 108, and a power source 110. The LED panel 102 includes a plurality of LED strings (e.g., LED strings 111, 112, 113, 114, 115, and 116). Each LED string includes one or more LEDs 118 connected in series. The LEDs 118 can include, for example, white LEDs, red, green, or blue (RGB) LEDs, organic LEDs (OLEDs), etc.

The power source 110 is configured to provide an output voltage $V_{OUT}$ having a magnitude adjusted based on an adjust signal 119 (ADJ). Each LED string is driven by the adjustable voltage $V_{OUT}$ received at the head end of the LED string via a voltage bus 120 (e.g., a conductive trace, wire, etc.). In the embodiment of FIG. 1, the power source 110 is implemented as a boost converter configured to drive the output voltage $V_{OUT}$ using an input voltage $V_{IN}$.

Each LED driver includes a set of one or more LED inputs and a corresponding se of one or more of current regulators. Each LED input is configured to couple to a tail end of a corresponding LED string of a subset of the plurality of LED strings associated with the LED driver such that the current flow through the coupled LED string is regulated by the corresponding current regulator at or near a fixed current (e.g., 30 mA) when activated. In the example of FIG. 1, the LED driver 104 includes LED inputs 121 and 122 coupled to the tail ends of LED strings 111 and 112, respectively, the LED driver 105 includes LED inputs 123 and 124 coupled to the tail ends of LED strings 113 and 114, and the LED driver 106 includes LED inputs 125 and 126 coupled to the tail ends of LED strings 115 and 116, respectively. Although the LED system 100 is illustrated as having three LED drivers, with each LED driver being associated with a subset of two LED strings for ease of illustration, the techniques described herein are not limited to any particular number of LED drivers or any particular number of LED strings per LED driver. To illustrate, various implementations could include, for example, one, two, four, eight, or sixteen LED strings per LED driver.

Each LED driver also includes an input to receive pulse width modulation (PWM) data to control the activation, and timing thereof, of the LED strings of the corresponding subset via the current regulators of the LED driver. To illustrate, the LED driver 104 includes an input 127 to receive PWM $DATA_A$, the LED driver 105 includes an input 128 to receive PWM $DATA_B$, and the LED driver 106 includes an input 129 to receive PWM $DATA_C$. Each LED driver can receive the same PWM data or each LED driver can receive a different set of PWM data. For example, in an implementation whereby the LED strings 111-116 are white LEDs used for backlighting, each of the LED drivers 104-106 may receive the same PWM data. However, in an implementation whereby each LED driver controls LED strings of a different color (e.g., red LEDs for LED driver 104, blue LEDs for LED driver 105, and green LEDs for LED driver 106), each LED driver may receive a different set of PWM data that is specific to the corresponding color type.

Further, each LED driver includes an upstream interface and a downstream interface to facilitate connection of the LED drivers in series so as to serially communicate minimum tail voltage information between the LED drivers and to the feedback controller 108. In the depicted example, the LED driver 104 includes an upstream interface 131 connected to an output interface 130 of the feedback controller 108, and a downstream interface 132, the LED driver 105 includes an upstream interface 133 connected to the downstream interface 132 and a downstream interface 134, and the LED driver 106 includes an upstream interface 135 connected to the downstream interface 134 and a downstream interface 136 connected to an input interface 138 of the feedback controller 108. Any of a variety of signaling architectures can be used to facilitate communication between the downstream interface of one LED driver and the upstream interface of the next LED driver in the series (or between the output interface 130 and the upstream interface 131 or between the downstream interface 136 and the input interface 138). To illustrate, the serial connections between interfaces can include, for example, one wire interconnects (e.g., a 1-Wire® interconnect, an Inter-Integrated Circuit (I2C) interconnect, a System Management Bus (SMBus), or a proprietary interconnect architecture).

The feedback controller 108 includes the input interface 138 to receive an indicator of an overall minimum tail voltage of the plurality of LED strings 111-116, the output interface 130 to provide a preset/trigger signal 140 to the first LED driver in the series (i.e., LED driver 104), and an output to provide the adjust signal 119. The indicator of the overall minimum tail voltage of the plurality of LED strings 111-116 can include a digital indicator (identified as code value $C_{minFinal}$), such as, for example, an ADC code value generated from the minimum tail voltage. Alternately, the indicator can comprise an analog indicator (identified as voltage $V_{TminFinal}$), such as the minimum tail voltage itself, or a voltage derived from the minimum tail voltage. The feedback controller 108 is configured to compare the overall minimum tail voltage represented by the received indicator to a threshold (voltage $V_{thresh}$ for an analog indicator or code value $C_{thresh}$ for a digital indicator) and adjust the adjust signal 119 based on the relationship between the overall minimum tail voltage and the threshold voltage so as to adjust the magnitude of the output voltage $V_{OUT}$ provided by the power source 110 based on this relationship.

As described above, there may be considerable variation between the voltage drops across each of the LED strings 111-116 due to static variations in forward-voltage biases of the LEDs 118 of each LED string and dynamic variations due to the on/off cycling of the LEDs 118. Thus, there may be significant variance in the bias voltages needed to properly operate the LED strings 111-116. However, rather than drive a fixed output voltage $V_{OUT}$ that is substantially higher than what is needed for the smallest voltage drop as this is handled in conventional LED drivers, the LED system 100 utilizes a feedback mechanism that permits the output voltage $V_{OUT}$ to be adjusted so as to reduce or minimize the power consumption of the LED drivers 104, 105 and 106 in the presence of variances in voltage drop across the LED strings 111-116, as described below with reference to the methods 200, 300, and 400 of FIGS. 2, 3, and 4, respectively. In particular, each of the LED drivers 104-106 operates to activate the LED strings of their corresponding subsets based on activation and timing information determined from received PWM data. Concurrently, each of the LED drivers operates to determine the minimum tail voltage of the LED strings of its corresponding subset. The first LED driver in the series provides, via the downstream interface, an indicator of the minimum tail voltage of the corresponding subset of LED strings to the upstream interface of the second LED string in the series. The second LED driver and each subsequent LED driver in the series determines the minimum tail voltage of the LED strings of its corresponding subset (referred to herein as the "local minimum tail voltage"), compares this local minimum tail voltage with the minimum tail voltage represented by the indicator received from the upstream LED driver, and then provides to the next LED driver an indicator that represents the lower of the local minimum tail voltage and the minimum tail voltage represented by the indicator received from the upstream LED driver. The last LED driver in the series provides its indicator to the feedback controller 108, which then uses the overall minimum tail voltage represented by the received indicator to adjust the output voltage $V_{OUT}$ as appropriate.

Because the first LED driver in the cascaded series does not have an upstream LED driver (and thus an upstream minimum tail voltage with which to compare its local minimum tail voltage), the first LED driver is configured differently than the remainder of LED drivers in the cascaded series. In an implementation whereby the first LED driver is configured to implement using an analog indicator as feedback, the upstream interface of the first LED driver can be fixedly pulled to a high voltage via one or more pull-up resistors so that when the first LED driver compares its local minimum tail voltage with the voltage at the upstream interface, the local minimum tail voltage is always the lower than the high voltage and thus always provided as the first indicator to the next LED driver in the series. In implementations whereby digital indicators are transmitted between the LED drivers, the feedback controller 130 can transmit a code having a particular predefined value (e.g., a code value of all "1's") as the preset/trigger signal 140 so as to signal to the first LED driver that it is the first LED driver in the series. In response to this signal, the first LED driver configures its operation so as to automatically provide the local minimum tail voltage as the first indicator without first requiring comparison with another indicator.

To illustrate this cascade mechanism in the LED system 100 of FIG. 1, the LED driver 104 is the first LED driver in the series. Thus, when triggered by the preset/trigger signal 140, the LED driver 104 determines the local minimum tail voltage between the tail voltage $V_{T1}$ of the LED string 111 and the tail voltage $V_{T2}$ of the LED string 112. As there is no upstream LED driver (and thus no upstream minimum tail voltage for comparison), the LED driver 104 automatically provides an indicator 142 of the local minimum tail voltage of the LED strings 111 and 112 (identified as $V_{TminA}$) to the upstream interface 133 of the LED driver 105. In one embodiment, the provided indicator 142 is an analog indicator, such as the voltage $V_{TminA}$ itself or a voltage derived therefrom. In another embodiment, the LED driver 105 digitizes the minimum tail voltage $V_{TminA}$ and provides a digital code value $C_{minA}$ as the indicator 142. The LED driver 105, in turn, determines the local minimum tail voltage between the tail voltage $V_{T3}$ of the LED string 113 and the tail voltage $V_{T4}$ of the LED string 114, compares this local minimum tail voltage with the minimum tail voltage represented by the indicator 142 received from the LED driver 104, and provides an indicator 144 of the lower of the two voltages. As with the indicator 142, the indicator 144 can be an analog indicator (identified as the voltage $V_{TminB}$) or a digital representation (identified as code $C_{minB}$). The LED driver 105 then provides the indicator 144 to the upstream interface 135 of the LED driver 106. The LED driver 106 determines the local minimum tail voltage between the tail voltages $V_{T5}$ and $V_{T6}$ of the LED strings 115 and 116, respectively, compares this local minimum tail voltage with the minimum tail voltage $V_{TminB}$ represented by the indicator 144, and determines an indicator 146 as the lower of the two voltages (identified as voltage $V_{TminC}$). The indicator 146 likewise can be an analog indicator or a digital indicator (identified as code $C_{minC}$). The indicator 146 then is provided from the LED driver 106 to the feedback controller 108 as an indicator of the overall minimum tail voltage ($V_{TminFinal}$ or $C_{minFinal}$) of the plurality of LED strings 111-116 for use in controlling the output voltage $V_{OUT}$ as described herein.

In this manner, the indicator (either analog or digital) or other representation of the overall minimum tail voltage of the entire plurality of LED strings 111-116 is cascaded through the LED drivers 104-106 using a compare-and-forward approach such that the indicator output by the last LED driver in the series (e.g., LED driver 106) to the feedback controller 108 is an indicator of the lowest tail voltage of all of the LED strings 111-116. This serial cascade between the LED drivers of the LED system 100 for minimum tail voltage feedback purposes requires fewer and shorter interconnects between the LED drivers 105-107 and the feedback controller 108 than a star-type or spoke-and-hub-type configuration whereby each LED driver communicates the respective minimum tail voltage for its respective subset of LED strings directly back to the feedback controller.

In one embodiment, the feedback mechanism implemented by the cascaded LED drivers 104-106 and the feedback controller 108 operates substantially continuously such that indicators of the minimum tail voltage of the plurality of LED strings 111-116 are continuously being cascaded through the LED drivers 104-106 and the feedback controller 108 is continuously adjusting the output voltage $V_{OUT}$ based on this continuous stream of indicators. However, frequent adjustment to the output voltage $V_{OUT}$ can lead to overshooting or undershooting and other negative effects. Accordingly, in an alternate embodiment, the feedback mechanism operates in a more periodic context whereby the minimum tail voltage of the plurality of LED strings 111-116 is determined once for any given feedback cycle and the corresponding indicator is then cascaded through the LED drivers 104-106 for use by the feedback controller 108 in periodically adjusting the output voltage $V_{OUT}$. The feedback cycle of this mechanism can include, for example, a PWM cycle or a portion thereof, multiple PWM cycles, a display frame cycle or a portion thereof, a certain number of clock cycles, a duration between interrupts, and the like.

The components of the LED system 100 can be implemented in separate integrated circuit (IC) packages. To illustrate, each of the LED drivers 104-106 may be implemented as a separate IC package and the feedback controller 108 and some or all of the components of the power source 110 may be implemented together as another IC package 150. The series arrangement of the LED drivers 104-106 and the feedback controller 108 can facilitate extension of the LED system 100 to incorporate any number of LED strings subject only to timing restraints and power constraints because the feedback controller 108 requires only one output interface 130 and one input interface 138 to interface with a cascaded series of LED drivers regardless of the number of LED drivers in the series. In contrast, a spoke-type arrangement would require a feedback controller to have a separate interface to each LED driver, thereby causing the IC package implementing the feedback controller to be unnecessarily large to accommodate a large number of package pins for the interface requirements of the feedback controller.

Figure 2:
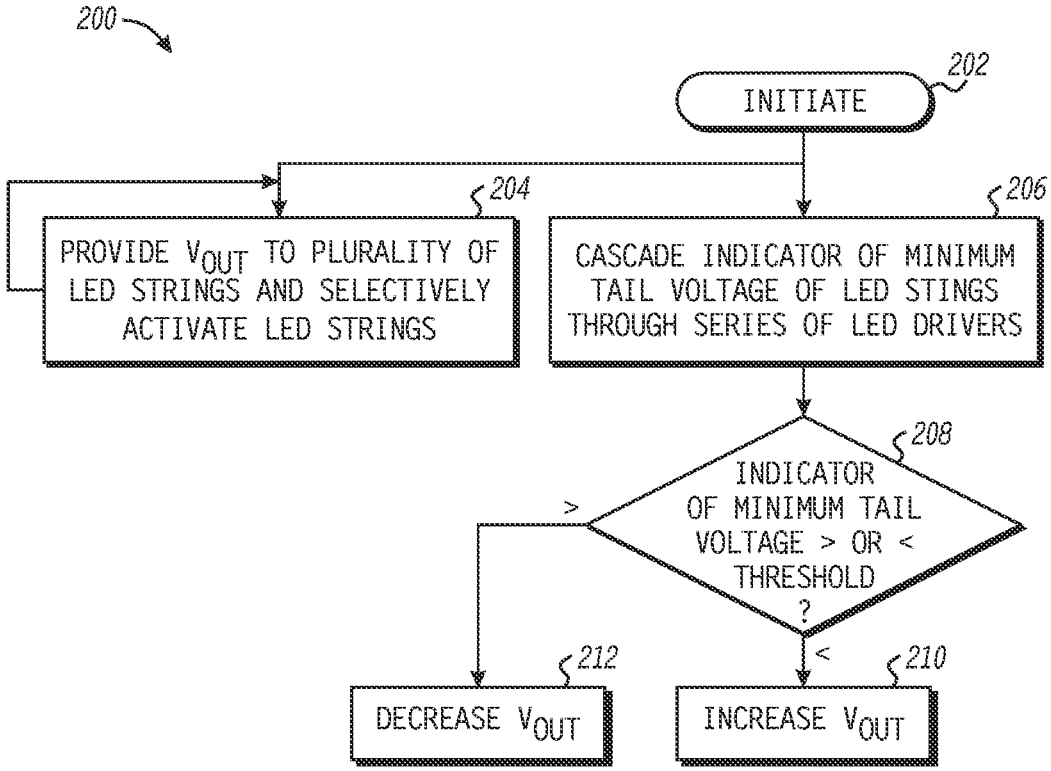
FIG. 2 is a flow diagram illustrating a method of operation of the LED system of FIG. 1 in accordance with at least one embodiment of the present disclosure.

FIG. 2 illustrates an example method 200 of operation of the power management mechanism of the LED system 100 of FIG. 1 in accordance with at least one embodiment of the present disclosure. At block 202, the LED system 100 is initiated by, for example, application of power or a power-on-reset (POR). At block 204, the power source 110 provides the output voltage $V_{OUT}$ to the head end of each of the plurality of LED strings 111-116 and the LED drivers 104-106 selectively activate LED strings of their respective subsets according to one or more sets of PWM data received at the LED drivers 104-106. Concurrently, at block 206 the LED drivers 104-106 determine the local minimum tail voltage for the LED strings of their corresponding subsets and cascade the overall minimum tail voltage of the entire plurality of LED strings 111-116 through the LED drivers 104-106 to the feedback controller 108. Example methods of operation of the LED drivers 104-106 for cascading the minimum tail voltage of the plurality of LED strings are described below with reference to FIGS. 3 and 4.

At block 208, the feedback controller 108 receives an indicator of the overall minimum tail voltage of the plurality of LED strings 111-116 for a given point in time or for a given feedback cycle from the LED driver 106. For an analog indicator, the feedback controller 108 compares the minimum tail voltage represented by the analog indicator with a threshold $V_{thresh}$ to determine the relationship between the two voltages. In one embodiment, the threshold voltage $V_{thresh}$ is the expected minimum threshold of the tail voltage of a LED string needed to ensure proper current regulation of the LED string. Thus, if the analog indicator of the overall minimum tail voltage of the plurality of LED strings 111-116 is below the threshold voltage $V_{thresh}$, there is a risk that one or more of the current regulators in the LED drivers 104-106 will be unable to effectively regulate the current in the corresponding LED string. Conversely, a situation whereby the analog indicator of the overall minimum tail voltage of the plurality of LED strings 111-116 is above the threshold voltage $V_{thresh}$ can lead to unnecessary power consumption by the LED strings. Accordingly, in the event that overall minimum tail voltage of the plurality of LED strings 111-116 is less than the threshold voltage $V_{thresh}$, at block 210 the feedback controller 108 configures the adjust signal 119 so as to direct the power source 110 to increase the output voltage $V_{OUT}$. Otherwise, in the event that the minimum tail voltage is greater than the threshold voltage $V_{thresh}$, at block 212 the feedback controller 108 configures the adjust signal 119 so as to direct the power source 110 to decrease the output voltage $V_{OUT}$. If the two voltages are equal, the feedback controller 108 can maintain the output voltage $V_{OUT}$ at its current level, or the output voltage $V_{OUT}$ can be adjusted up or down as appropriate.

Similarly, when a digital indicator of the minimum tail voltage is implemented, the feedback controller 108 compares the digital indicator with the threshold code $C_{thresh}$ to determine the relationship between the two code values, whereby the code value $C_{thresh}$ can represent the expected minimum threshold of the tail voltage of a LED string needed to ensure proper current regulation of the LED string. Accordingly, in the event that the digital indicator of the overall minimum tail voltage of the plurality of LED strings 111-116 is less than the threshold code $C_{thresh}$, at block 210 the feedback controller 108 configures the adjust signal 119 so as to direct the power source 110 to increase the output voltage $V_{OUT}$. Otherwise, in the event that digital indicator of the minimum tail voltage is greater than the threshold code $C_{thresh}$, at block 212 the feedback controller 108 configures the adjust signal 119 so as to direct the power source 110 to decrease the output voltage $V_{OUT}$. If the two codes are equal, the feedback controller 108 can maintain the output voltage $V_{OUT}$ at its current level, or the output voltage $V_{OUT}$ can be adjusted up or down as appropriate.

As discussed above, indicators of the minimum tail voltage of the plurality of LED strings 111-116 (e.g., $V_{TminA}$, $V_{TminB}$, and $V_{minC}$ or $C_{minA}$, $C_{minB}$, and $C_{minC}$, and $V_{TminFinal}$/$C_{minFinal}$) can be continuously cascaded through the feedback mechanism of the LED system 100 and thus the feedback process represented by blocks 206, 208, 210, and 212 can be continuously repeated for each concurring point in time. Alternately, a feedback cycle can be used to synchronize the feedback mechanism to a timing reference, such as a PWM cycle, a clock cycle, or a display frame cycle, and thus the feedback process of blocks 206, 208, 210, and 212 can be repeated for each feedback cycle. In this case, $V_{TminA}/C_{minA}$, $V_{T,minB}/C_{minB}$, $V_{TminC}/C_{minC}$, and $V_{TminFinal}/C_{minFinal}$ are the minimum indicators over the respective feedback cycle.

Figure 3:
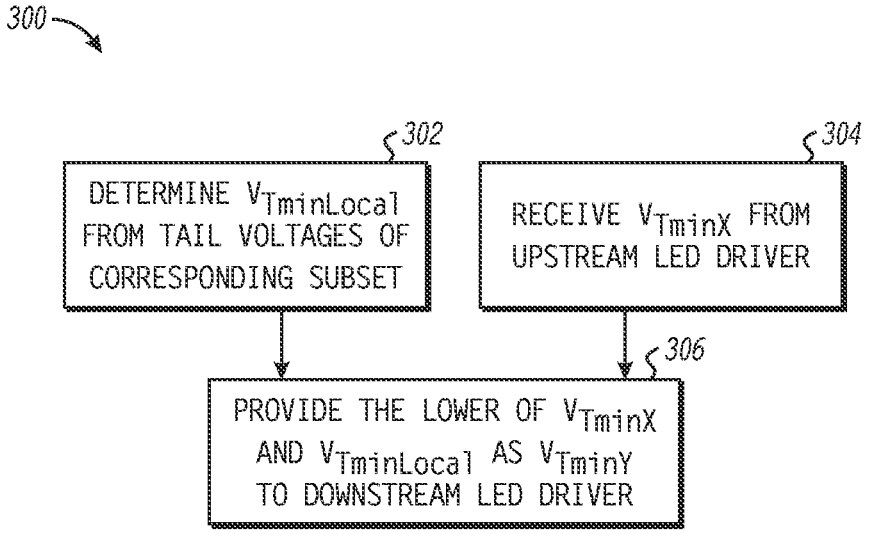
FIG. 3 is a flow diagram illustrating a method for cascading an analog indicator of the minimum tail voltage of a plurality of LED strings for dynamic control in accordance with at least one embodiment of the present disclosure.

FIG. 3 illustrates an example method 300 of operation of a LED driver of the LED system 100 of FIG. 1 in cascading an analog indicator as part of the cascading process of block 206 of FIG. 2 in accordance with at least one embodiment of the present disclosure. The method 300 represents the process repeated by each LED driver in the series with the exception of the first LED driver in the series (e.g., LED driver 104, FIG. 1).

At block 302, the LED driver determines the local minimum tail voltage ($V_{TminLocal}$) from the tail voltages of the subset of the LED strings associated with the LED driver. In one embodiment, the LED driver is configured to continuously provide the local minimum tail voltage. In another embodiment, the LED driver is configured to periodically determine the local minimum tail voltage in response to a synchronization signal, such as a PWM cycle signal or a frame rate signal.

Concurrently, at block 304 the LED driver receives, via the upstream interface, an analog indicator of the minimum tail voltage ($V_{TminX}$) of all of the LED strings associated with the LED drivers upstream of the present LED driver. In one embodiment, the analog indicator is the upstream minimum tail voltage itself, or a voltage representative of the upstream minimum tail voltage.

At block 306, the LED driver compares the local minimum tail voltage $V_{TminLocal}$ with the upstream minimum tail voltage $V_{TminX}$ of all of the LED strings associated with the upstream LED drivers and provides to the downstream interface an analog indicator that represents the lower of these two voltages. The analog indicator is thereby transmitted to the upstream interface of the next, or downstream, LED driver in the series.

The first LED driver in the series operates in a slightly different manner. Because there is no upstream LED driver for the first LED driver in the series, the first LED driver, in one embodiment, receives a signal (e.g., a particular data value) from the feedback controller 108 that signals to the first LED driver that it is to automatically provide the local minimum tail voltage as an indicator to the next LED driver in the series without performing the comparison described above. In an alternate embodiment, in an implementation whereby the voltage at the upstream interface serves as the analog indicator, the upstream interface of the first LED driver can be pulled to a high voltage such that the local minimum tail voltage determined by the first LED driver is always lower than the voltage at the upstream interface of the first LED driver, thereby ensuring that the first LED driver provides its local minimum tail voltage as the indicator to the next LED driver in the series.

Figure 4:
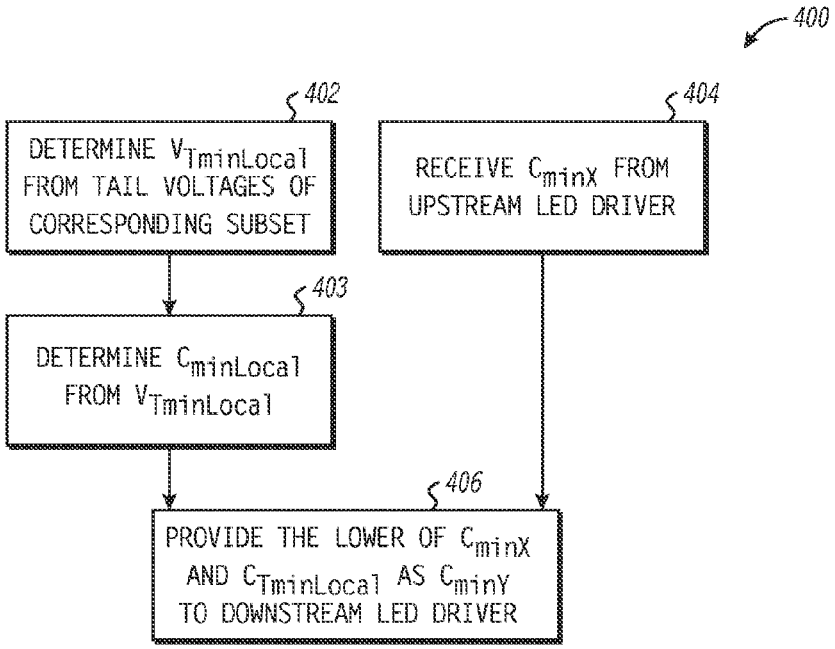
FIG. 4 is a flow diagram illustrating a method for cascading a digital indicator of the minimum tail voltage of a plurality of LED strings for dynamic control in accordance with at least one embodiment of the present disclosure.

FIG. 4 illustrates an example method 400 of operation of a LED driver of the LED system 100 of FIG. 1 in cascading a digital indicator as part of the cascading process of block 206 of FIG. 2 in accordance with at least one embodiment of the present disclosure. The method 400 represents the process repeated by each LED driver in the series with the exception of the first LED driver in the series (e.g., LED driver 104, FIG. 1).

At block 402, the LED driver determines the local minimum tail voltage ($V_{TminLocal}$) from the tail voltages of the subset of the LED strings associated with the LED driver as similarly described at block 302 of FIG. 3. At block 403, the LED driver digitizes the local minimum tail voltage $V_{TminLocal}$ using, for example an analog-to-digital converter (ADC) to generate a corresponding digital code $C_{minLocal}$. Concurrently, at block 404 the LED driver receives, via the upstream interface, a digital indicator (code $C_{minX}$) of the upstream minimum tail voltage ($V_{TminX}$) of all of the LED strings associated with the LED drivers upstream of the present LED driver. The digital indicator can include, for example, a digital code value generated by an ADC of an upstream LED driver from the minimum tail voltage $V_{TminX}$ as part of the application of the process represented by blocks 402 and 403 at an upstream LED driver. At block 406, the LED driver determines the relationship between the code $C_{minLocal}$ and the code $C_{minX}$ and provides the lower of the two values to the downstream interface a digital indicator that is thereby transmitted to the next, or downstream, LED driver in the series.

Thus, as illustrated by methods 300 and 400, each LED driver in the series operates to output to the next LED driver in the series an indicator (analog or digital) of the lowest minimum tail voltage of the LED strings determined by that point in the cascading series of LED drivers.

Figure 5:
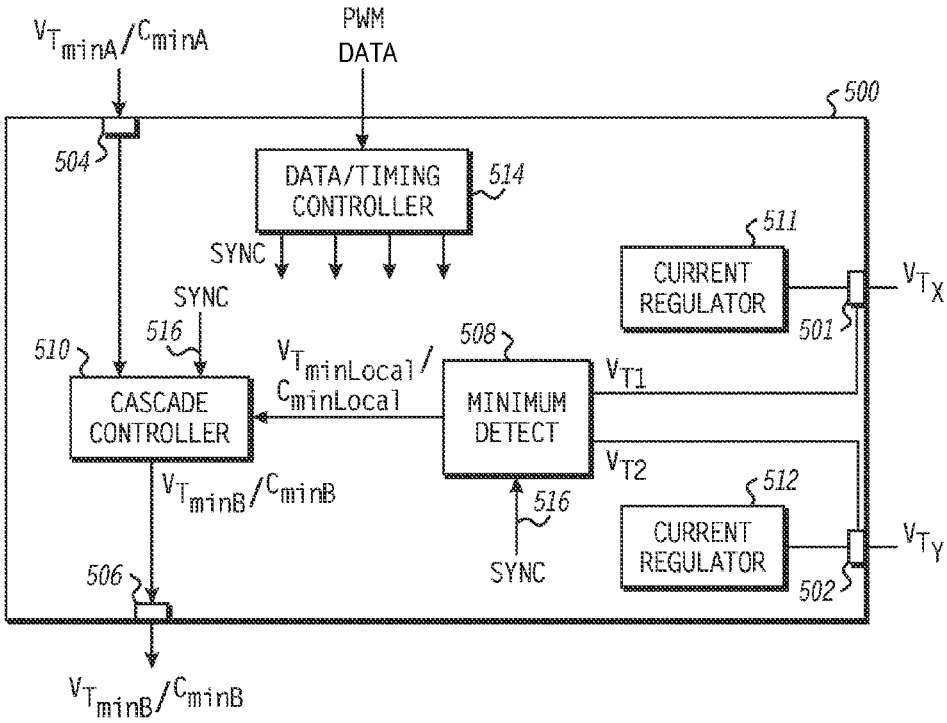
FIG. 5 is a block diagram illustrating an example implementation of a cascaded LED driver of the LED system of FIG. 1 in accordance with at least one embodiment of the present disclosure.

FIG. 5 illustrates an example implementation of a LED driver 500 (corresponding to the LED drivers 104, 105, and 106 of FIG. 1) in accordance with at least one embodiment of the present disclosure. For ease of illustration, the LED driver 500 is described in the context of supporting a subset of two LED strings. However, the implementation of the LED driver 500 is not limited to this number, or any particular number, of LED strings.

The LED driver 500 includes LED inputs 501 and 502, an upstream interface 504, a downstream interface 506, a minimum detect module 508, a cascade controller 510, current regulators 511 and 512, and a data/timing controller 514. The LED input 501 is configured to couple to a tail end of a first LED string (having a variable tail voltage $V_{TX}$) of the subset and the LED input 502 is configured to couple to a tail end of a second LED string (having a variable tail voltage $V_{TY}$) of the subset. The current regulator 511 is configured to activate the first LED string and regulate the current through the first LED string based on control signaling from the data/timing controller 514. Likewise, the current regulator 512 is configured to activate the second LED string and regulate the current through the second LED string based on control signaling from the data/timing controller 514. The upstream interface 504 is configured to couple to the downstream interface of an upstream LED driver and the downstream interface 506 is configured to couple to the upstream interface of a downstream LED driver.

The minimum detect module 508 includes inputs coupled to the LED inputs 501 and 502 to receive the tail voltages $V_{TX}$ and $V_{TY}$ and an output to provide an indicator of the lower of these two tail voltages as the indicator of the local minimum tail voltage for the subset of LED strings managed by the LED driver 500. In one embodiment, the minimum detect module 508 continuously provides the indicator of the local minimum tail voltage. In an analog indicator context, the indicator output of the minimum detect module 508 can include, for example, the voltage $V_{TminLocal}$ that the minimum detect module 508 continuously varies as the voltages $V_{TX}$ and $V_{TY}$ vary. In a digital indicator context, the indicator output of the minimum detect module 508 can include a stream of code values generated by an ADC from the lower of the voltages $V_{TX}$ and $V_{TY}$ at any given point of a clock reference used by the ADC. In another embodiment, the minimum detect module 508 is synchronized to a given feedback cycle using a sync signal 516 such that the minimum detect module 508 outputs a single indicator (digital or analog) for every given feedback cycle. The sync signal 516 can be generated by the data/timing controller 514 from the PWM data or the sync signal 516 can be received (as upstream sync signal from the upstream LED driver via the upstream interface 504. Further, the sync signal 516 can be propagated to, or regenerated for, the downstream LED driver via the downstream interface 506. Example implementations of the minimum detect module 508 are illustrated below with reference to FIGS. 6, 8, and 9.

The cascade controller 510 includes an input to receive, via the upstream interface 504, an indicator ($V_{TminA}/C_{minA}$) representative of the cumulative minimum tail voltage determined from the upstream LED drivers, an input to receive the local minimum tail voltage indicator(s) from the minimum detect module 508, and an output to provide an indicator ($V_{TminB}/C_{minB}$) representative of the cumulative minimum tail voltage determined from the upstream LED drivers and the LED driver 500. As described in greater detail below, the cascade controller 510 compares the cumulative minimum tail voltage represented by the indicator received from the upstream LED driver with the local minimum tail voltage represented by the indicator received from the minimum detect module 508 and provides the indicator representative of the lower of the two as the downstream indicator ($V_{TminB}/C_{minB}$). In one embodiment, the cascade controller 510 is configured to continuously perform this comparison process. In another embodiment, the cascade controller 510 is synchronized to a given feedback cycle using the sync signal 516 such that the cascade controller 510 outputs a single indicator (digital or analog) for every given feedback cycle. Example implementations of the cascade controller 510 are illustrated below with reference to FIGS. 7 and 8.

The data/timing control controller 514 receives PWM data associated with the LED strings of the corresponding subset and is configured to provide control signals to the other components of the LED driver 500 based on the timing and activation information represented by the PWM data. To illustrate, the data/timing controller 514 provides control signals to the current regulators 511 and 512 to control which of the LED strings are active during corresponding portions of their respective PWM cycles. The data/timing control module 514 also can provide the sync signal 516 to control the timing of the minimum detect module 508 and the cascade controller 510.

Figure 6:
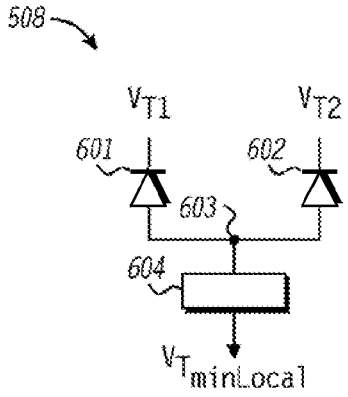
FIG. 6 is a circuit diagram illustrating an analog implementation of a minimum detect module or a cascade controller of the cascaded LED driver of FIG. 5 in accordance with at least one embodiment of the present disclosure.

FIG. 6 illustrates an analog implementation of the minimum detect module 508 of FIG. 5 as a diode-OR circuit in accordance with at least one embodiment of the present disclosure. As illustrated, the diode-OR circuit can include forward-biased diodes (e.g., LED diodes 601 and 602 for the two LED strings managed by the LED driver 500), each diode having a cathode coupled to the tail end of a corresponding LED string of the subset and an anode connected to an output node 603 that serves to provide the minimum tail voltage $V_{TminLocal}$ of the subset of LED strings connected to the diode-OR circuit (less the forward voltage drop of the diodes). Further, in one embodiment, the minimum detect module 508 can include a compensation circuit 604 having an input connected to the output node 603 and an output connected to the downstream interface of the LED driver 500, whereby the compensation circuit 604 is configured to cancel or compensate for the forward voltage drop of the diodes.

In addition to illustrating a configuration of the minimum detect module 508, FIG. 6 also can be adapted for implementation of a diode-OR circuit for the cascade controller 510 (FIG. 5) so as to select between the indicator of the local minimum tail voltage or an incoming indicator from an upstream LED driver.

Figure 7:
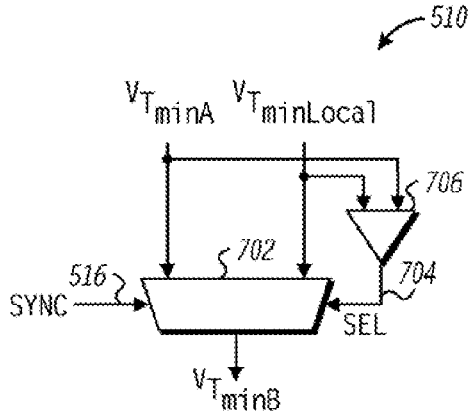
FIG. 7 is a diagram illustrating another analog implementation of a cascade controller of the cascaded LED driver of FIG. 5 in accordance with at least one embodiment of the present disclosure.

FIG. 7 illustrates another analog implementation of the cascade controller 510 of FIG. 5 in accordance with at least one embodiment of the present disclosure. In the depicted example, the cascade controller 510 includes an analog multiplexer 702 (or switch) having one voltage input to receive the local minimum tail voltage $V_{TminLocal}$ generated by the minimum detect module 508 (FIG. 5), another voltage input to receive the cumulative minimum tail voltage ($V_{TminA}$) represented by the indicator received from the upstream LED driver, and an output to provide a select one of the two input voltages as the cumulative minimum tail voltage ($V_{TminB}$) for the LED driver downstream of the LED driver 500 based on the state of a select signal 704. Further, the analog multiplexer 702 can include an enable input to receive the sync signal 516 (FIG. 5) so that the analog multiplexer 702 synchronizes its output to the feedback cycle represented by the sync signal 516. The cascade controller 510 further includes an analog comparator 706 comprising an input to receive the local minimum tail voltage $V_{Tmin}$ Local generated by the minimum detect module 508, an input to receive the cumulative minimum tail voltage ($V_{TminA}$) represented by the indicator received from the upstream LED driver, and an output to configure the state of the select signal 704 based on the relationship between the voltage $V_{Tmin}$ Local and the voltage $V_{TminA}$ so as to direct the analog multiplexer 702 to output the lower of the two voltages.

Figure 8:
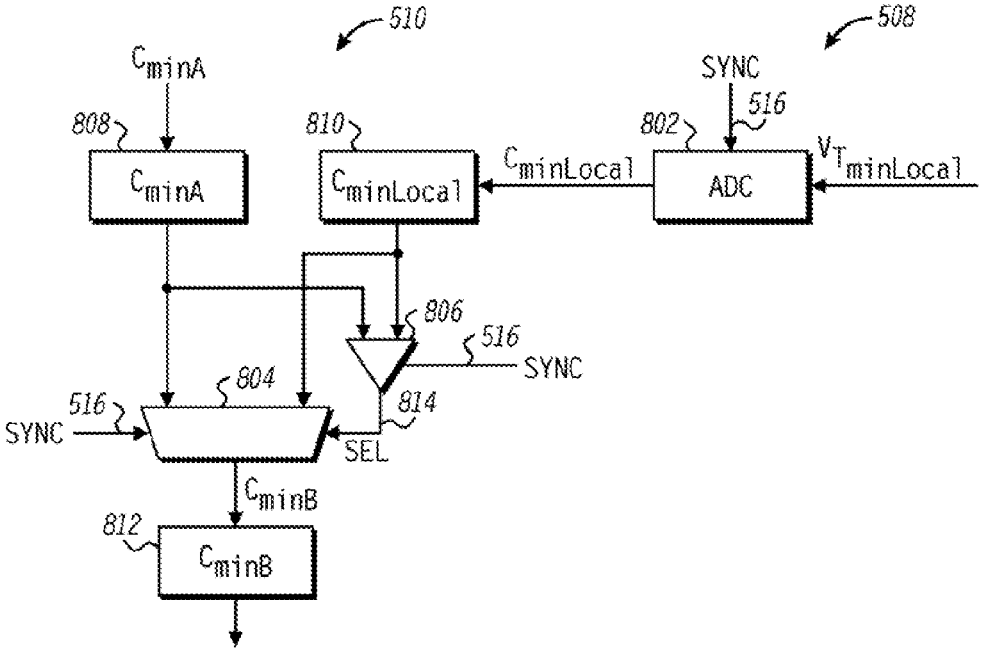
FIG. 8 is a diagram illustrating a digital implementation of the minimum detect module and the cascade controller of the cascaded LED driver of FIG. 5 in accordance with at least one embodiment of the present disclosure.

FIG. 8 illustrates an example implementation of the minimum detect module 508 and the cascade controller 510 in the context of digital indicators in accordance with at least one embodiment of the present disclosure. In this example, the minimum detect module 508 includes a mechanism to determine the local minimum tail voltage $V_{TminLocal}$ of the subset of LED strings associated with the LED driver 500 (FIG. 5), such as by using the diode-OR circuit of FIG. 6. The minimum detect module 508 further includes an ADC 802 to generate a code value $C_{minLocal}$ representative of the level of the local minimum tail voltage $V_{TminLocal}$ at a particular point in time or during a feedback cycle (e.g., as signaled by the sync signal 516). For the later case, the ADC 802 or another minimum select module can be configured to select the lowest code value generated for the feedback cycle as the code value $C_{minLocal}$. The cascade controller 510 includes a digital multiplexer 804, a digital comparator 806, and buffers 808, 810, and 812. The buffer 808 stores the code $C_{minA}$ received from the upstream LED driver (and which represents the cumulative minimum tail voltage of the LED strings of the upstream LED drivers), the buffer 810 stores the code value $C_{minLocal}$ generated by the ADC 802, and the buffer 812 stores a code $C_{minB}$ that is provided to the LED driver downstream of the LED driver 500. The multiplexer 804 includes an input coupled to the buffer 808, an input coupled to the buffer 810, an input to receive a select signal 814, and an output coupled to the buffer 812, whereby the digital multiplexer 804 selects either the value stored in the buffer 808 or the value stored in the buffer 810 for output to the buffer 812 based on the state of the select signal 814. The digital comparator 806 includes an input coupled to the buffer 808, an input coupled to the buffer 810 and an output to provide the select signal 814. In operation, the digital comparator 806 compares the code $C_{minA}$ in the buffer 808 with the code $C_{minLocal}$ in the buffer 810 and directs the multiplexer 804 to output the lower of the two codes via the select signal 814. Further, either or both the multiplexer 804 and the digital comparator 806 can be synchronized to a feedback cycle via the sync signal 516.

Figure 9:
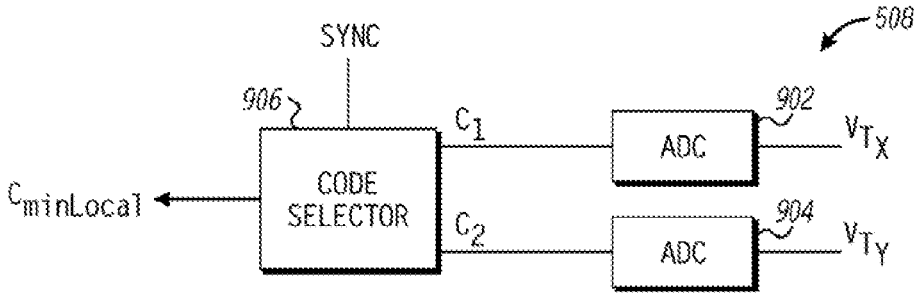
FIG. 9 is a diagram illustrating another digital implementation of the minimum detect module of the cascaded LED driver of FIG. 5 in accordance with at least one embodiment of the present disclosure.

FIG. 9 illustrates another example implementation of the minimum detect module 508 (FIG. 5) in a digital indicator context in accordance with at least one embodiment of the present disclosure. In the depicted embodiment, the minimum detect module 508 includes ADCs 902 and 904 and a code selector 906. The ADC 902 has an input coupled to the tail end of a first LED string and an output to provide one or more codes $C_1$ representative of the level of the tail voltage $V_{TX}$ of the first LED string at corresponding points in time. Likewise, the ADC 904 has an input coupled to the tail end of a second LED string and an output to provide one or more codes $C_2$ representative of the level of the tail voltage $V_{TY}$ of the second LED string at corresponding points in time. The code selector 906 receives the codes output by the ADCs 902 and 904 and selects the lowest code of the received codes for output as the code $C_{minLocal}$ described above. In one embodiment, the code selector 906 compares codes as they are received and thus produces a stream of codes $C_{minLocal}$ at the rate of the code generation by the ADCs 902 and 904. In another embodiment, the ADCs 902 and 904 each generate a respective stream of codes over a given feedback cycle and the code selector 906 continuously monitors the generated codes to identify the lowest code generated during the feedback cycle. At the end of the feedback cycle (as signaled by, for example, the sync signal 516), the code selector 906 outputs the lowest code for the feedback cycle as the code $C_{minLocal}$ for that feedback cycle. The code $C_{minLocal}$ then can be forwarded to the downstream LED driver as part of the cascading process described above.

Figure 10:
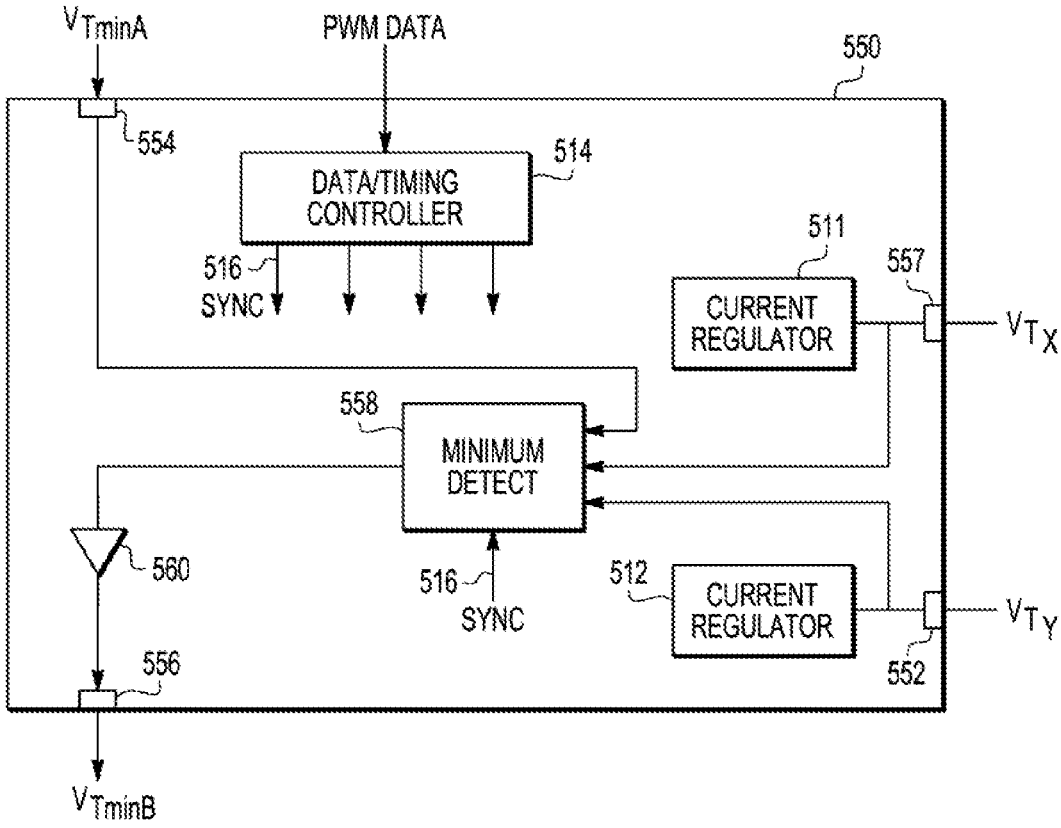
FIG. 10 is a block diagram illustrating another example implementation of a cascaded LED driver of the LED system of FIG. 1 based on a cascaded analog minimum threshold voltage in accordance with at least one embodiment of the present disclosure.

FIG. 10 illustrates an example implementation of a LED driver 550 (corresponding to the LED drivers 104, 105, and 106 of FIG. 1) in accordance with at least one embodiment of the present disclosure. As with the LED driver 500 of FIG. 5, the LED driver 550 of FIG. 10 is described in the context of supporting a subset of two LED strings for ease of illustration. However, the implementation of the LED driver 550 is not limited to this number, or any particular number, of LED strings.

The LED driver 550 includes LED inputs 551 and 552, an upstream interface 554, a downstream interface 556, a minimum detect module 558, a buffer 560, as well as the current regulators 511 and 512 and the data/timing controller 514 described above with respect to FIG. 5. The LED input 551 is configured to couple to a tail end of a first LED string (having a variable tail voltage $V_{TX}$) of the subset and the LED input 552 is configured to couple to a tail end of a second LED string (having a variable tail voltage $V_{TY}$) of the subset. The current regulator 511 is configured to activate the first LED string and regulate the current through the first LED string based on control signaling from the data/timing controller 514. Likewise, the current regulator 512 is configured to activate the second LED string and regulate the current through the second LED string based on control signaling from the data/timing controller 514. The upstream interface 554 is configured to couple to the downstream interface of an upstream LED driver and the downstream interface 556 is configured to couple to the upstream interface of a downstream LED driver.

The minimum detect module 558 includes inputs coupled to the LED inputs 551 and 552 to receive the tail voltages $V_{TX}$ and $V_{TY}$, an input coupled to the upstream interface 554 to receive an indicator voltage ($V_{TminA}$) representative of the cumulative minimum tail voltage determined by the upstream LED drivers in the same manner described below and an output to provide a representation the lowest of these input voltages as an indicator voltage ($V_{TminB}$) representative of the lower of the local minimum tail voltage for the subset of LED strings managed by the LED driver 550 and the minimum tail voltage of all of the upstream subsets of LED strings managed by the upstream LED drivers. The indicator voltage $V_{TminB}$ then may be provided to the buffer 560 for output via the downstream interface 556 to the downstream LED driver or, if the LED driver 550 is the last LED driver in the series, to the feedback controller 108 (FIG. 1).

In one embodiment, the minimum detect module 558 continuously provides the indicator voltage $V_{TminB}$ such that the indicator voltage $V_{TminB}$ continuously varies as the voltages $V_{TminA}$, $V_{TX}$ and $V_{TY}$ vary. In another embodiment, the minimum detect module 558 is synchronized to a given feedback cycle using a sync signal 516 such that the minimum detect module 558 outputs a single indicator voltage ($V_{TminB}$) for every given feedback cycle. The sync signal 516 can be generated by the data/timing controller 514 from the PWM data or the sync signal 516 can be received (as upstream sync signal from the upstream LED driver via the upstream interface 554. Further, the sync signal 516 can be propagated to, or regenerated for, the downstream LED driver via the downstream interface 556.

As described above, the data/timing control controller 514 receives PWM data associated with the LED strings of the corresponding subset and is configured to provide control signals to the other components of the LED driver 550 based on the timing and activation information represented by the PWM data. The data/timing control module 514 also can provide the sync signal 516 to control the timing of the minimum detect module 558.

Figure 11:
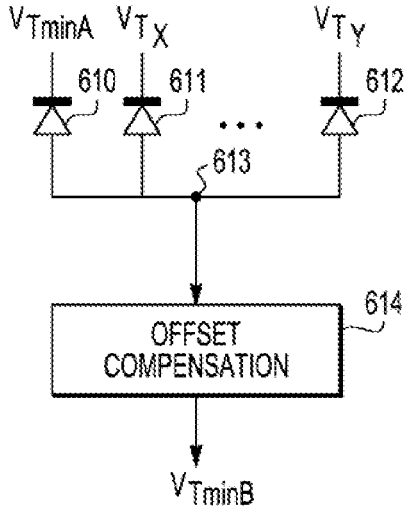
FIG. 11 is a circuit diagram illustrating an analog implementation of the minimum detect module of the cascaded LED driver of FIG. 10 in accordance with at least one embodiment of the present disclosure.

FIG. 11 illustrates an example implementation of the minimum detect module 558 of FIG. 10 as a diode-OR circuit in accordance with at least one embodiment of the present disclosure. As illustrated, the diode-OR circuit can include forward-biased diodes 610, 611, and 612, each diode having an a cathode coupled to the tail end of a corresponding LED string of the subset and an anode connected to an output node 613 that serves to provide the lowest voltage of the voltages $V_{TminA}$, $V_{TX}$, and $V_{TY}$ connected to the diode-OR circuit (less the forward voltage drop of the diodes). Further, in one embodiment, the minimum detect module 558 can include a compensation circuit 614 having an input connected to the output node 613 and an output connected to the downstream interface of the LED driver 550, whereby the compensation circuit 614 is configured to cancel or compensate for the forward voltage drop of the diodes.

Figure 12:
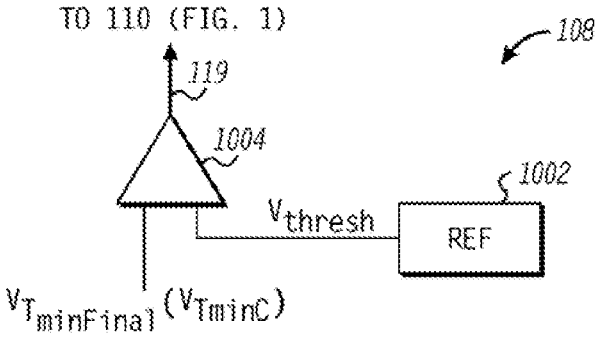
FIG. 12 is a diagram illustrating an implementation of a feedback controller of the LED system of FIG. 1 based on a cascaded analog indicator of the minimum tail voltage of the plurality of LED strings of the LED system of FIG. 1 in accordance with at least one embodiment of the present disclosure.

FIG. 12 illustrates an example implementation of the feedback controller 108 of the LED system 100 of FIG. 1 in an analog indicator context in accordance with at least one embodiment of the present disclosure. In the depicted example, the feedback controller 108 includes a voltage reference 1002 to generate the threshold voltage $V_{thresh}$ and a error amplifier 1004 having an input to receive the final analog indicator ($V_{TminFinal}$) from the last LED driver in the series, an input to receive the threshold voltage $V_{thresh}$, and an output to provide the adjust signal 119 based on the relationship of the two input voltages. In this example, the error amplifier 1004 configures the adjust signal 119 so as to direct the power source 110 (FIG. 1) to increase the output voltage $V_{OUT}$ when the minimum tail voltage represented by the voltage $V_{TminFinal}$ is less than the threshold voltage $V_{thresh}$ and to decrease the output voltage $V_{OUT}$ when the minimum tail voltage represented by the voltage $V_{TminFinal}$ is greater than the threshold voltage $V_{thresh}$.

Figure 13:
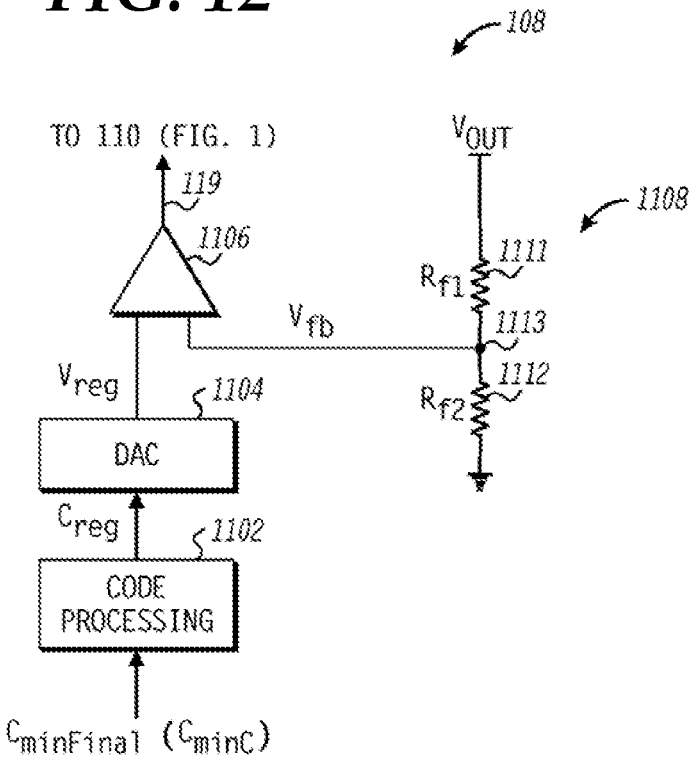
FIG. 13 is a diagram illustrating an alternate implementation of the feedback controller of the LED system of FIG. 1 based on a cascaded indicator of the minimum tail voltage of the plurality of LED strings of the LED system of FIG. 1 in accordance with at least one embodiment of the present disclosure.

FIG. 13 illustrates another example implementation of the feedback controller 108 of the LED system 100 of FIG. 1 in a digital indicator context in accordance with at least one embodiment of the present disclosure. In this example, the feedback controller 108 includes a code processing module 1102, a digital-to-analog converter (DAC) 1104, an error amplifier 1106, and a voltage divider 1108.

The voltage divider 1108 includes resistors 1111 and 1112 connected in series. The resistor 1111 has a terminal coupled to the output of the power source 110 (FIG. 1) to receive the output voltage and a terminal coupled to a node 1113 that provides a voltage $V_{fb}$, whereby the resistor 1111 has a resistance $R_{f1}$. The resistor 1112 has a terminal coupled to the node 1113, a terminal connected to a ground reference, and a resistance $R_{f2}$. Thus, in this embodiment the voltage $V_{fb}$ comprises a feedback voltage proportional to the output voltage $V_{OUT}$ (i.e., $V_{fb}=V_{OUT}*R_{f2}/(R_{f1}+R_{f2})$).

The code processing module 1102 receives the cascaded code $C_{minFinal}$ from the last LED driver in the series and generates a code value $C_{reg}$ based on the relationship of the minimum tail voltage $V_{TminFinal}$ to the threshold voltage $V_{thresh}$ revealed by the comparison of the code value $C_{minFinal}$ to a code value $C_{thresh}$ that represents the voltage $V_{thresh}$. As described herein, the value of the code value $C_{reg}$ affects the resulting change in the output voltage $V_{OUT}$. Thus, when the code value $C_{minFinal}$ is greater than the code value $C_{thresh}$, a value for $C_{reg}$ is generated so as to reduce the output voltage $V_{OUT}$, which in turn is expected to reduce the minimum tail voltage of the plurality of LED strings powered by the output voltage $V_{OUT}$ closer to the threshold voltage $V_{thresh}$. To illustrate, the code processing module 1102 compares the code value $C_{minFinal}$ to the code value $C_{thresh}$. If the code value $C_{minFinal}$ is less than the code value $C_{thresh}$, an updated value for $C_{reg}$ is generated so as to increase the output voltage $V_{OUT}$. Conversely, if the code value $C_{minFinal}$ is greater than the code value $C_{thresh}$ an updated value for $C_{reg}$ is generated so as to decrease the output voltage $V_{OUT}$. The resulting code $C_{reg}$ is provided to the DAC 1104, which converts the code $C_{reg}$ to a corresponding voltage $V_{reg}$. The error amplifier 1106 configures the adjust signal 119 based on the relationship of the voltage $V_{reg}$ to the voltage $V_{fb}$ so as to adjust the output voltage $V_{OUT}$ as described above.

The control of the output voltage $V_{OUT}$ is based on the relationship between the feedback voltage $V_{fb}$ and the voltage $V_{reg}$ and thus dependent on the resistances $R_{f1}$ and $R_{f2}$ of the voltage divider 1108, the gain of the DAC 1104, and the gain of the ADC of the LED driver that generated the code $C_{minFinal}$. In view of these dependencies, the updated value for $C_{reg}$ can be set to $$C_{reg}(\text{updated}) = C_{reg}(\text{current}) + offset1 \quad \text{EQ. 1}$$

$$offset1 = \frac{R_{f2}}{R_{f1} + R_{f2}} \times \frac{(C_{thresh} - C_{minFinal})}{\text{Gain_ADC} \times \text{Gain_DAC}} \quad \text{EQ. 2}$$

whereby $R_{f1}$ and $R_{f2}$ represent the resistances of the resistor 1111 and the resistor 1112, respectively, of the voltage divider 1108 and Gain_ADC represents the gain of the ADC (in units code per volt) of the LED driver used to generate the code $C_{minFinal}$ and Gain_DAC represents the gain of the DAC 1104 (in unit of volts per code). Depending on the relationship between the voltage $V_{TminFinal}$ and the voltage $V_{thresh}$ (or the code value $C_{minFinal}$ and the code value $C_{thresh}$), the offset1 value can be either positive or negative.

Alternately, when the code $C_{minFinal}$ indicates that the minimum tail voltage $V_{TminFinal}$ is at or near zero volts (e.g., $C_{minFinal}$=0) the value for updated $C_{reg}$ can be set to $$C_{reg}(\text{updated}) = C_{reg}(\text{current}) + \text{offset2} \quad \text{EQ. 3}$$

whereby offset2 corresponds to a predetermined voltage increase in the output voltage $V_{OUT}$ (e.g., 1 V increase) so as to affect a greater increase in the minimum tail voltage $V_{TminFinal}$.

Figure 14:
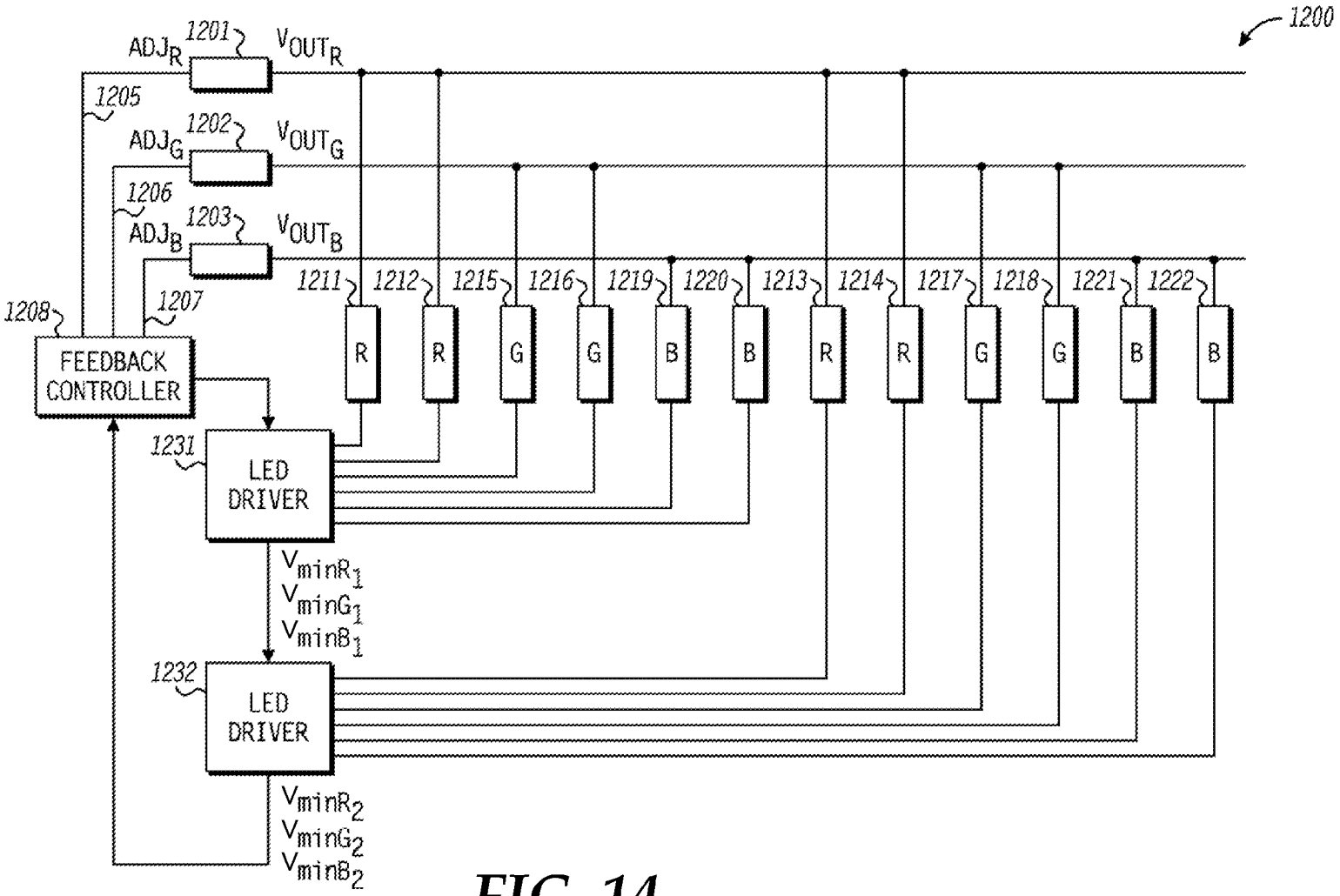
FIG. 14 is a diagram illustrating another example LED system implementing LED strings of different colors in accordance with at least one embodiment of the present disclosure.

FIG. 14 illustrates an example LED system 1200 utilizing LED strings of different colors in accordance with at least one embodiment of the present disclosure. In certain LED systems, different color LEDs are used to provide the color components of the displayed image. For example, certain LED systems employ separate red, green, and blue LED strings to achieve the RGB color scheme. However, LEDs of different colors often have different operating characteristics and thus often are operated at different fixed currents or experience a significantly different voltage drops for the same number of LEDs in sequence. Accordingly, it often is advantageous to drive each color LED string with a different power source. The present invention can be advantageously implemented in such system as illustrated by FIG. 14. Although FIG. 14 illustrates an implementation using digital indicators, the implementation of FIG. 14 can be likewise adapted for use with analog indicators.

In the depicted example, the LED system 1200 includes power sources 1201, 1202, and 1203 to provide output voltage $V_{OUTR}$, $V_{OUTG}$, and $V_{OUTB}$, respectively. The LED system 1200 further includes a LED panel having a plurality of red LED strings 1211, 1212, 1213, and 1214, a plurality of green LED strings 1215, 1216, 1217, and 1218, and a plurality of blue LED strings 1219, 1220, 1221, and 1222. The red LED strings are driven by the output voltage $V_{OUTR}$, the green LED strings are driven by the output voltage $V_{OUTG}$, and the blue LED strings are driven by the output voltage $V_{OUTB}$. Further, in the example of FIG. 12, there are two cascaded LED drivers 1231 and 1232, whereby the LED driver 1231 controls the LED strings 1211, 1212, 1215, 1216, 1219, and 1220 and the LED driver 1232 controls the LED strings 1213, 1214 1217, 1218, 1221, and 1222. The LED system 1200 further includes a feedback controller 1208 to control the power supplies 1201, 1202, and 1203 via adjust signals 1205, 1206, and 1207.

In operation, each of the power supplies 1201, 1202, and 1203 supplies the corresponding output voltage to the associated color LED strings. The LED drivers 1231 and 1232 regulate the currents through their associated LED string subsets based on received PWM data. Concurrently, the LED driver 1231 determines the tail voltages for the LED strings 1211, 1212, 1215, 1216, 1219, and 1220. From these tail voltages the LED driver 1231 determines the minimum tail voltages $V_{minR1}$, $V_{minG1}$, and $V_{minB1}$ for the red, green, and blue LED string subsets, respectively, and outputs these voltages to the LED driver 1232. The LED driver 1232 likewise determines the tail voltages of the LED strings 1213, 1214, 1217, 1218, 1221, and 1222, and the determines the lowest of these tail voltages and the received minimum tail voltages $V_{minR1}$, $V_{minG1}$, and $V_{minB1}$ for each color-type to determine the minimum tail voltages $V_{minG2}$, and $V_{minB2}$. The LED driver 1232 then provides the minimum tail voltages $V_{minR2}$, $V_{minG2}$, and $V_{minB2}$ to the feedback controller 1208, which then uses these minimum tail voltages to adjust the output voltages of the corresponding power supplies in the manner described above on per-color basis. In one embodiment, the indicator for each color is provided in series between LED drivers and the feedback controller 1208. Alternately, each LED driver can have separate, parallel lines so as to receive and transmit analog indicators for each color.

In accordance with one aspect of the present disclosure, a method is provided. At a first light emitting diode (LED) driver coupled to a tail end of each of a first subset of one or more LED strings of a plurality of LED strings, the method includes determining a tail voltage of each LED string of the first subset, receiving, at a first external interface of the first LED driver, a first voltage representative of a minimum tail voltage of a second subset of one or more LED strings of the plurality of LED strings, and providing, to a second external interface of the first LED driver, a second voltage representing the lowest voltage of the first voltage and the tail voltages of the one or more LED strings of the first subset. The method further can include adjusting an output voltage supplied to a head end of each of the plurality of LED strings based on the second voltage. Adjusting the output voltage can include increasing the output voltage responsive to a minimum tail voltage represented by the second voltage being less than a threshold voltage and decreasing the output voltage responsive to the minimum tail voltage represented by the second voltage being greater than the threshold voltage. In one embodiment, determining the tail voltage of each LED string of the first subset comprises determining the tail voltage of each LED string for a predetermined feedback cycle. In accordance with one aspect, providing the second voltage comprises providing the second voltage to an interface of a second LED driver via the second external interface of the first LED driver, and the method further includes providing the first LED driver and second LED driver as separate integrated circuit devices.

In accordance with a further aspect, at a second LED driver coupled to a tail end of each LED string of the second subset of LED strings, the method includes receiving, at a first external interface of the second LED driver, a third voltage representative of a third minimum tail voltage of a third subset of the plurality of LED strings from a third LED driver, determining a tail voltage of each LED string of the second subset, and responsive to determining a minimum tail voltage of the tail voltages of the LED strings of the second subset is lower than the third voltage, providing a representation of the minimum tail voltage as the second voltage to a second external interface of the second LED driver that is coupled to the first external interface of the first LED driver.

In accordance with another aspect, at a second LED driver coupled to a tail end of each LED string of a third subset of LED strings of the plurality of LED strings, the method includes receiving, at a first external interface of the second LED driver, the second voltage from a third LED driver associated with the second subset of LED strings, determining a tail voltage of each LED string of the third subset, and responsive to determining the second voltage is lower than any of the tail voltages of the LED strings of the third subset, providing the second voltage to a second external interface of the second LED driver that is coupled to the first external interface of the first LED driver.

In accordance with yet another aspect, at a second LED driver coupled to a tail end of each LED string of a third subset of LED strings of the plurality of LED strings, the method includes receiving, at a first external interface of the second LED driver coupled to the second external interface of the first LED driver, the second voltage from the first LED driver, determining a tail voltage of each LED string of the third subset, and responsive to determining the second voltage is lower than any of the tail voltages of the LED strings of the third subset, providing the second voltage to a second external interface of the second LED driver that is coupled to an external interface of a third LED driver.

In accordance with an additional aspect, at a second LED driver coupled to a tail end of each LED string of a third subset of LED strings of the plurality of LED strings, the method includes receiving, at a first external interface of the second LED driver coupled to the second external interface of the first LED driver, the second voltage from the first LED driver, determining a tail voltage of each LED string of the third subset, and responsive to determining a minimum tail voltage of the tail voltages of the LED strings of the third subset is lower than the second voltage, providing a third voltage representative of the minimum tail voltage to a second external interface of the second LED driver that is coupled to an external interface of a third LED driver.

In accordance with another aspect, the first subset of LED strings and the second subset of LED strings each comprises LED strings of a first color and the first LED driver is further coupled to a tail end of each of a third subset of LED strings comprising LED strings of a second color, and the method further includes, at the first LED driver, determining a tail voltage of each LED string of the third subset, receiving, at the first external interface of the first LED driver, a third voltage representative of a minimum tail voltage of a fourth subset of the plurality of LED strings, the fourth subset comprising LED strings of the second color, and providing, to the second external interface of the first LED driver, a fourth voltage representing the lowest voltage of the third voltage and the tail voltages of the LED strings of the third subset.

In accordance with another aspect of the present disclosure, a LED driver is provided. The LED driver includes a first set of one or more LED inputs, each LED input adapted to be coupled to a tail end of a corresponding LED string of a first subset of a plurality of LED strings, a first external interface to receive a first voltage, a first minimum detect module coupled to the first plurality of inputs and to the first external interface, the first minimum detect module to determine a second voltage representative of the lowest voltage of first voltage and tail voltages of the one or more LED strings of the first subset, and a second external interface to provide the second voltage. In one embodiment, the first minimum detect module comprises a diode-OR circuit having a plurality of diodes, each diode comprising a cathode coupled to a corresponding one of a corresponding LED input of the set of LED inputs or the first external interface, and each diode comprising an anode connected to a common node. Further, the LED driver can include a compensation circuit comprising an input coupled to the common node and an output coupled to the second external interface, the compensation circuit to compensate for a forward voltage drop of the diodes.

In a further aspect, the first subset comprises LED strings of a first color, and the LED driver further comprises a second plurality of LED inputs, each LED input adapted to be coupled to a tail end of a corresponding LED string of a second subset of a plurality of LED strings, the second subset comprising LED strings of a second color. In this instance, the first external interface further is to receive a third voltage and the LED driver further includes a second minimum detect module coupled to the second plurality of inputs and to the first external interface, the second minimum detect module to determine a fourth voltage representative of the lowest voltage of the third voltage and tail voltages of the LED strings of the second subset. The second external interface further is to provide the fourth voltage.

In accordance with yet another aspect of the present disclosure, a LED system is provided. The LED system includes a plurality of LED strings, a power source to provide an output voltage to a head end of each of the plurality of LED strings, and a plurality of LED drivers coupled in series. Each LED driver is coupled to a tail end of each LED string of a corresponding subset of the plurality of LED strings, and each LED driver of at least a subset of the plurality of LED drivers is to determine a tail voltage of each LED string of the corresponding subset and to output a voltage to the next LED driver in the series, the voltage representative of the lowest voltage of a corresponding voltage received from a previous LED driver in the series or the minimum tail voltage of the tail voltages of the LED strings of the corresponding subset. The LED system further includes a feedback controller to control the power source to adjust the output voltage based on the voltage output by the last LED driver in the series. In one embodiment, each LED driver of the plurality of LED drivers is implemented as a separate integrated circuit device.

In accordance with one aspect, the plurality of LED drivers comprises a first LED driver in the series to determine a tail voltage of each LED string of a first subset of LED strings corresponding to the first LED driver and to output a first voltage to a second LED driver in the series, the first voltage representative of a minimum tail voltage of the tail voltages of the LED strings of the first subset, and the second LED driver in the series to determine a tail voltage of each LED string of a second subset of LED strings corresponding to the second LED driver and to output a second voltage to a third LED driver in the series, the second voltage representative of the lowest voltage of the first voltage and the tail voltages of the LED strings of the second subset.

In accordance with another aspect, the plurality of LED drivers comprises the last LED driver in the series to determine a tail voltage of each LED string of a subset of LED strings corresponding to the last LED driver and to receive a first voltage from a previous LED driver in the series, the first voltage representative of a minimum tail voltage of those LED strings of the plurality of LED strings not included in the subset corresponding to the last LED driver, wherein the voltage output by the last LED driver comprises a second voltage representative of the lowest voltage of the first voltage and the tail voltages of the LED strings of the subset corresponding to the last LED driver.

In one aspect, the feedback controller is to control the power source to increase the output voltage in response to a minimum tail voltage represented by the voltage output by the last LED driver in the series being less than a threshold voltage and to decrease the output voltage in response to the minimum tail voltage represented by the voltage output by the last LED driver in the series being greater than the threshold voltage. In this instance, the LED system can include a voltage divider to generate the threshold voltage based on the output voltage.

Other embodiments, uses, and advantages of the disclosure will be apparent to those skilled in the art from consideration of the specification and practice of the disclosure disclosed herein. The specification and drawings should be considered exemplary only, and the scope of the disclosure is accordingly intended to be limited only by the following claims and equivalents thereof.

What is claimed is:

1. A method comprising:

at a first light emitting diode (LED) driver coupled to a tail end of each of a first subset of one or more LED strings of a plurality of LED strings:

determining a tail voltage of each LED string of the first subset;

receiving, at a first external interface of the first LED driver, a first voltage representative of a minimum tail voltage of a second subset of one or more LED strings of the plurality of LED strings; and providing, to a second external interface of the first LED driver, a second voltage representing the lowest voltage of the first voltage and the tail voltages of the one or more LED strings of the first subset.

2. The method of claim 1, further comprising:

adjusting an output voltage supplied to a head end of each of the plurality of LED strings based on the second voltage.

3. The method of claim 2, wherein adjusting the output voltage comprises:

increasing the output voltage responsive to a minimum tail voltage represented by the second voltage being less than a threshold voltage; and decreasing the output voltage responsive to the minimum tail voltage represented by the second voltage being greater than the threshold voltage.

4. The method of claim 1, wherein determining the tail voltage of each LED string of the first subset comprises determining the tail voltage of each LED string for a predetermined feedback cycle.

5. The method of claim 1, further comprising:

at a second LED driver coupled to a tail end of each LED string of the second subset of one or more LED strings:

receiving, at a first external interface of the second LED driver, a third voltage representative of a third minimum tail voltage of a third subset of the plurality of LED strings from a third LED driver;

determining a tail voltage of each LED string of the second subset; and responsive to determining the minimum tail voltage of the second subset is lower than the third voltage, providing a representation of the minimum tail voltage of the second subset as the second voltage to a second external interface of the second LED driver that is coupled to the first external interface of the first LED driver.

6. The method of claim 1, further comprising:

at a second LED driver coupled to a tail end of each LED string of a third subset of one or more LED strings of the plurality of LED strings:

receiving, at a first external interface of the second LED driver, the second voltage from a third LED driver associated with the second subset of LED strings;

determining a tail voltage of each LED string of the third subset; and responsive to determining the second voltage is lower than any of the tail voltages of the one or more LED strings of the third subset, providing the second voltage to a second external interface of the second LED driver that is coupled to the first external interface of the first LED driver.

7. The method of claim 1, further comprising:

at a second LED driver coupled to a tail end of each LED string of a third subset of one or more LED strings of the plurality of LED strings:

receiving, at a first external interface of the second LED driver coupled to the second external interface of the first LED driver, the second voltage from the first LED driver;

determining a tail voltage of each LED string of the third subset; and responsive to determining the second voltage is lower than any of the tail voltages of the LED strings of the third subset, providing the second voltage to a second external interface of the second LED driver that is coupled to an external interface of a third LED driver.

8. The method of claim 1, further comprising:

at a second LED driver coupled to a tail end of each LED string of a third subset of one or more LED strings of the plurality of LED strings:

receiving, at a first external interface of the second LED driver coupled to the second external interface of the first LED driver, the second voltage from the first LED driver;

determining a tail voltage of each LED string of the third subset; and responsive to determining a minimum tail voltage of the tail voltages of the one or more LED strings of the third subset is lower than the second voltage, providing a third voltage representative of the minimum tail voltage to a second external interface of the second LED driver that is coupled to an external interface of a third LED driver.

9. The method of claim 1, wherein providing the second voltage comprises providing the second voltage to an interface of a second LED driver via the second external interface of the first LED driver, the method further comprising:

providing the first LED driver and second LED driver as separate integrated circuit devices.

10. The method of claim 1, wherein the first subset of one or more LED strings and the second subset of one or more LED strings each comprises one or more LED strings of a first color and the first LED driver is further coupled to a tail end of each of a third subset of one or more LED strings of a second color, the method further comprising:

at the first LED driver:

determining a tail voltage of each LED string of the third subset;

receiving, at the first external interface of the first LED driver, a third voltage representative of a minimum tail voltage of a fourth subset of the plurality of LED strings, the fourth subset comprising one or more LED strings of the second color; and providing, to the second external interface of the first LED driver, a fourth voltage representing the lowest voltage of the third voltage and the tail voltages of the one or more LED strings of the third subset.

11. A light emitting diode (LED) driver comprising:

a first set of one or more LED inputs, each LED input adapted to be coupled to a tail end of a corresponding LED string of a first subset of a plurality of LED strings;

a first external interface to receive a first voltage;

a first minimum detect module coupled to the first set of one or more LED inputs and to the first external interface, the first minimum detect module to determine a second voltage representative of the lowest voltage of the first voltage and tail voltages of the one or more LED strings of the first subset; and a second external interface to provide the second voltage.

12. The LED driver of claim 11, wherein:

the first minimum detect module comprises a diode-OR circuit having a plurality of diodes, each diode comprising a cathode coupled to a corresponding one of a corresponding LED input of the first set of LED inputs or the first external interface, and each diode comprising an anode connected to a common node.

13. The LED driver of claim 12, further comprising a compensation circuit comprising an input coupled to the common node and an output coupled to the second external interface, the compensation circuit to compensate for a forward voltage drop of the diodes.

14. The LED driver of claim 11, wherein the first subset comprises one or more LED strings of a first color, and the LED driver further comprising:

a second set of one or more LED inputs, each LED input adapted to be coupled to a tail end of a corresponding LED string of a second subset of a plurality of LED strings, the second subset comprising one or more LED strings of a second color;

the first external interface further to receive a third voltage;

a second minimum detect module coupled to the second set of one or more LED inputs and to the first external interface, the second minimum detect module to determine a fourth voltage representative of the lowest voltage of the third voltage and tail voltages of the one or more LED strings of the second subset; and the second external interface further to provide the fourth voltage.

15. A light emitting diode (LED) system comprising:

a plurality of LED strings;

a power source to provide an output voltage to a head end of each of the plurality of LED strings;

a plurality of LED drivers coupled in a series, each LED driver coupled to a tail end of each LED string of a corresponding subset of the plurality of LED strings, and each LED driver of at least a subset of the plurality of LED drivers to determine a tail voltage of each LED string of the corresponding subset and to output a voltage to the next LED driver in the series, the voltage representative of the lowest voltage of a corresponding voltage received from a previous LED driver in the series or the minimum tail voltage of the tail voltages of the LED strings of the corresponding subset; and a feedback controller to control the power source to adjust the output voltage based on the voltage output by the last LED driver in the series.

16. The LED system of claim 15, wherein the plurality of LED drivers comprises:

a first LED driver in the series to determine a tail voltage of each LED string of a first subset of LED strings corresponding to the first LED driver and to output a first voltage to a second LED driver in the series, the first voltage representative of a minimum tail voltage of the tail voltages of the LED strings of the first subset; and the second LED driver in the series to determine a tail voltage of each LED string of a second subset of LED strings corresponding to the second LED driver and to output a second voltage to a third LED driver in the series, the second voltage representative of the lowest voltage of the first voltage and the tail voltages of the LED strings of the second subset.

17. The LED system of claim 15, wherein the plurality of LED drivers comprises:

the last LED driver in the series to determine a tail voltage of each LED string of a subset of LED strings corresponding to the last LED driver and to receive a first voltage from a previous LED driver in the series, the first voltage representative of a minimum tail voltage of those LED strings of the plurality of LED strings not included in the subset corresponding to the last LED driver, wherein the voltage output by the last LED driver comprises a second voltage representative of the lowest voltage of the first voltage and the tail voltages of the LED strings of the subset corresponding to the last LED driver.

18. The LED system of claim 15, wherein each LED driver of the plurality of LED drivers is implemented as a separate integrated circuit device.

19. The LED system of claim 15, wherein the feedback controller is to control the power source to increase the output voltage in response to a minimum tail voltage represented by the voltage output by the last LED driver in the series being less than a threshold voltage and to decrease the output voltage in response to the minimum tail voltage represented by the voltage output by the last LED driver in the series being greater than the threshold voltage.

20. The LED system of claim 19, further comprising:

a voltage divider to generate the threshold voltage based on the output voltage.

* * * * *